US006289876B1

(12) United States Patent
Mackert

(10) Patent No.: US 6,289,876 B1
(45) Date of Patent: Sep. 18, 2001

(54) FUEL INJECTOR

(75) Inventor: Robert J. Mackert, Downers Grove, IL (US)

(73) Assignee: International Truck and Engine Corporation, Chicago, IL (US)

( * ) Notice: Subject to any disclaimer, the term of this patent is extended or adjusted under 35 U.S.C. 154(b) by 0 days.

(21) Appl. No.: 09/280,315

(22) Filed: Mar. 29, 1999

(51) Int. Cl.[7] ..... F02M 55/02
(52) U.S. Cl. ..... 123/470; 123/509
(58) Field of Search ..... 123/509, 470, 123/468, 469, 495; 239/600

(56) References Cited

U.S. PATENT DOCUMENTS

| | | | | |
|---|---|---|---|---|
| 3,908,613 | | 9/1975 | Loby . | |
| 4,066,213 | * | 1/1978 | Stampe | 239/533.3 |
| 4,213,564 | * | 7/1980 | Hulsing | 239/88 |
| 4,522,182 | * | 6/1985 | Mowbray | 123/509 |
| 4,528,959 | * | 7/1985 | Hauser, Jr. | 123/470 |
| 4,615,323 | * | 10/1986 | LeBlanc et al. | 123/509 |
| 4,901,700 | | 2/1990 | Knight et al. . | |
| 5,121,730 | | 6/1992 | Ausman et al. . | |
| 5,325,834 | * | 7/1994 | Ballheimer et al. | 123/446 |
| 5,392,749 | | 2/1995 | Stockner et al. . | |
| 5,419,298 | | 5/1995 | Nolte et al. . | |
| 5,460,329 | | 10/1995 | Sturman . | |
| 5,566,658 | | 10/1996 | Edwards et al. . | |
| 5,617,828 | * | 4/1997 | Kuegel et al. | 123/468 |
| 5,836,286 | | 11/1998 | Timmer et al. . | |
| 5,983,864 | * | 11/1999 | Chockley et al. | 123/470 |
| 6,021,762 | * | 2/2000 | Zeidler et al. | 123/509 |
| 6,026,786 | * | 2/2000 | Groff et al. | 123/501 |

* cited by examiner

*Primary Examiner*—Carl S. Miller
(74) *Attorney, Agent, or Firm*—Dennis Kelly Sullivan; Jeffrey P. Calfa; Gilberto Hernandez

(57) ABSTRACT

A clamping device for clamping a fuel injector to the cylinder head of an internal combustion engine, the fuel injector having a fuel injector body including a injector nozzle tip includes a hold down device for clamping to an object and a seal device for effecting a fluid seal with a plurality of fluid passageways defined in the cylinder head, the sealing device associated with each fluid passageway being compressible by a unidirectional force applied to the hold down device. A fuel injector for an internal combustion engine, the fuel injector having a fuel injector body including a injector nozzle tip includes a hold down device for clamping to an object and a seal device for effecting a fluid seal with a plurality of fluid passageways defined in the object, at least one seal device having a dimensional range in which an effective seal is made, the dimensional range being at least as great as the range of manufacturing tolerances existing is between the fuel injector and the object.

38 Claims, 7 Drawing Sheets

FIG. 2
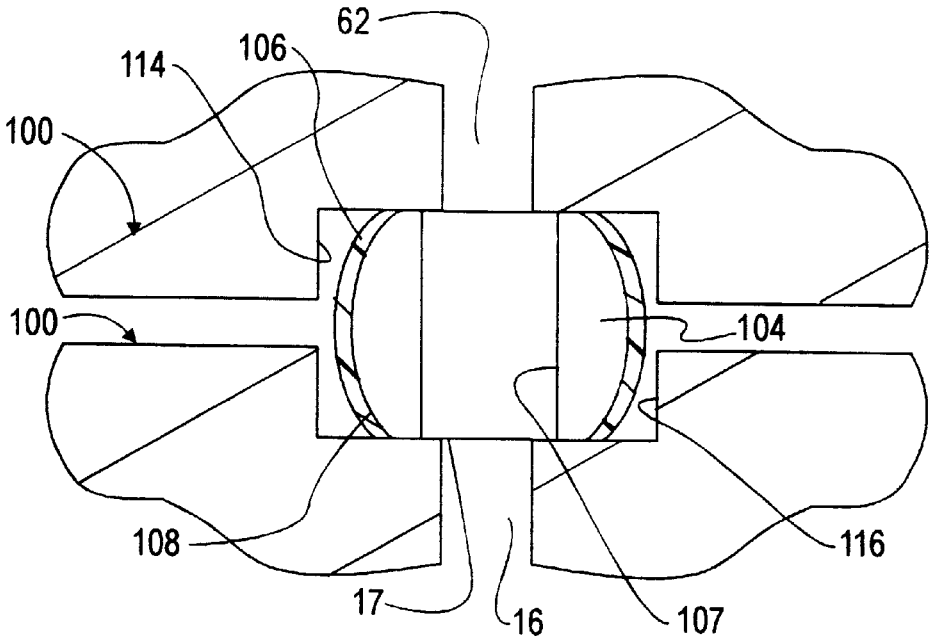
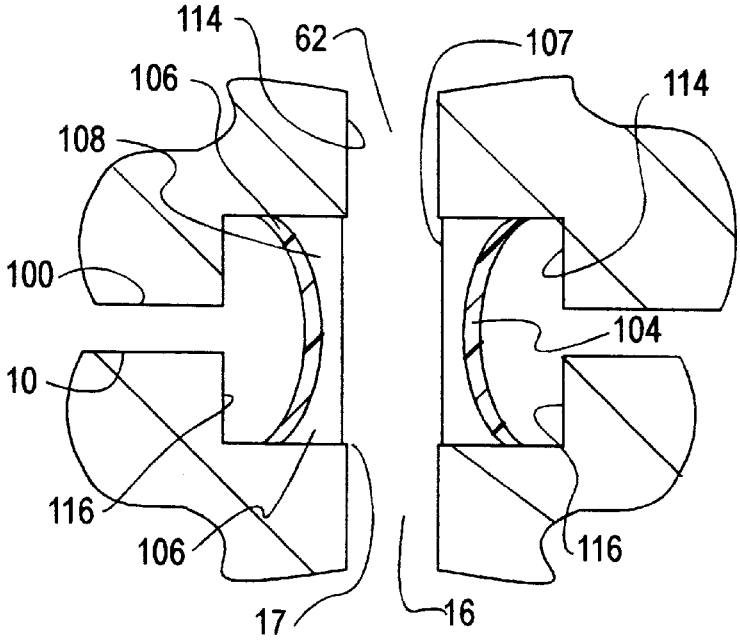
FIG. 3

FIG. 4
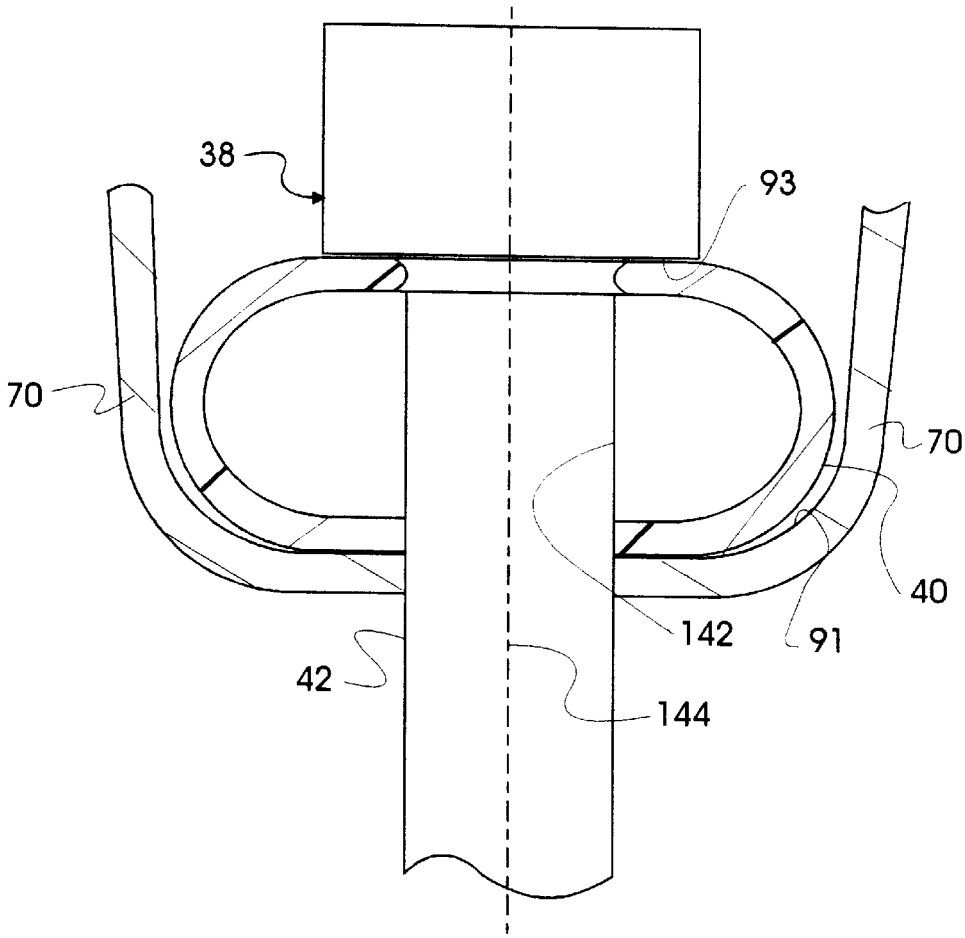
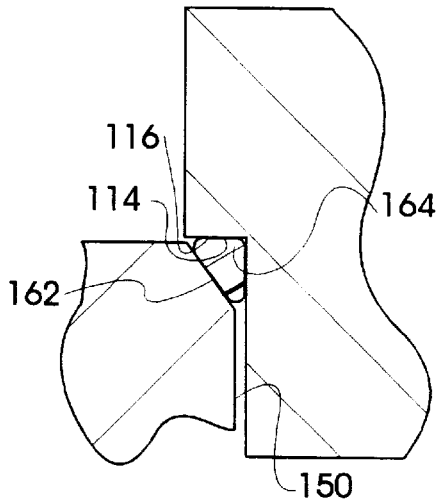
FIG. 6a
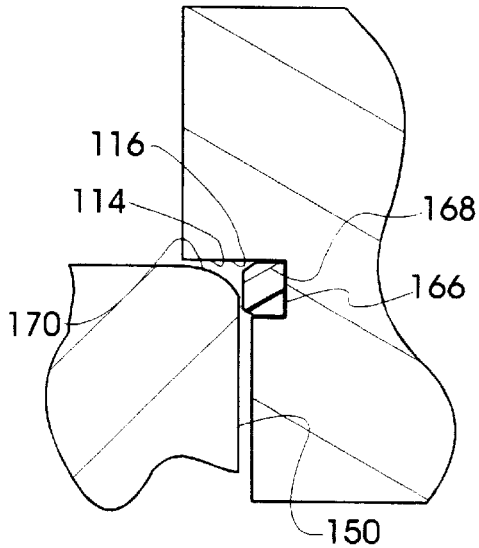
FIG. 6b

FIG. 5
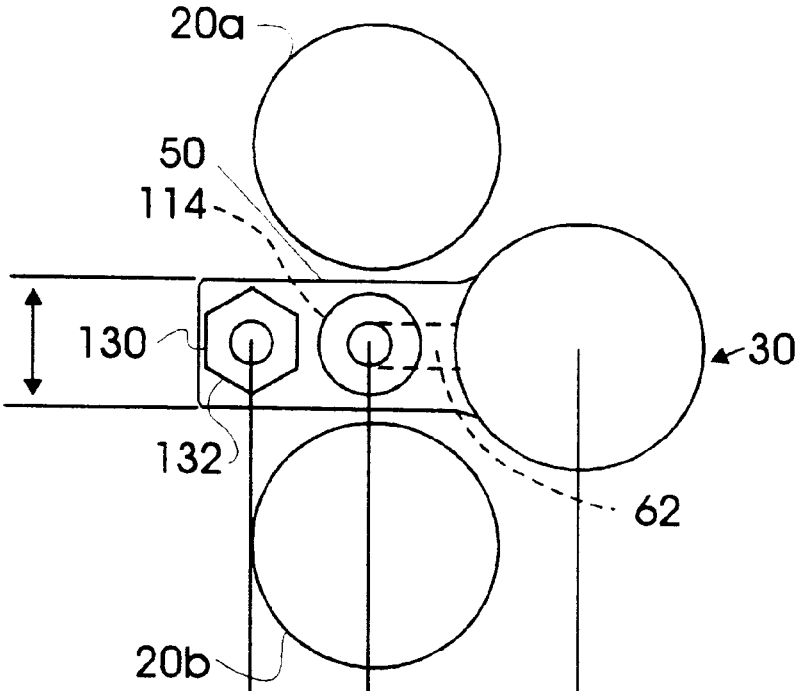
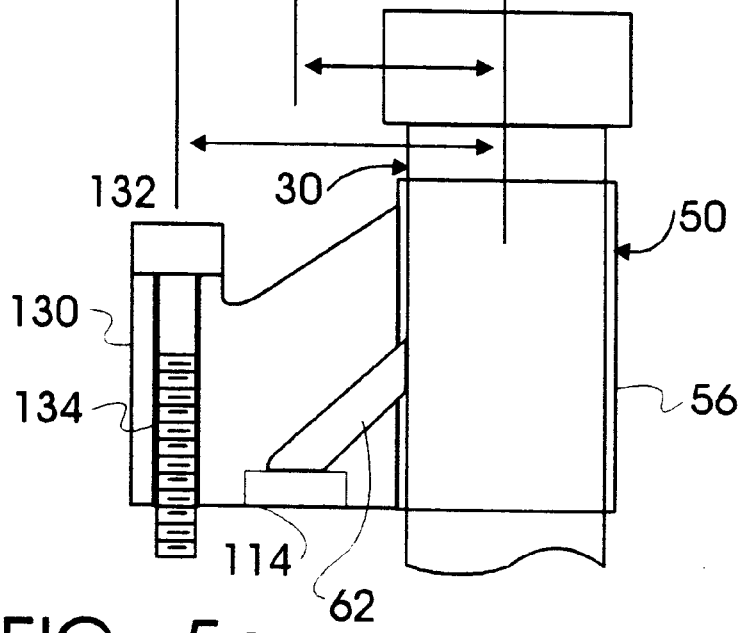
FIG. 5a

FIG. 9
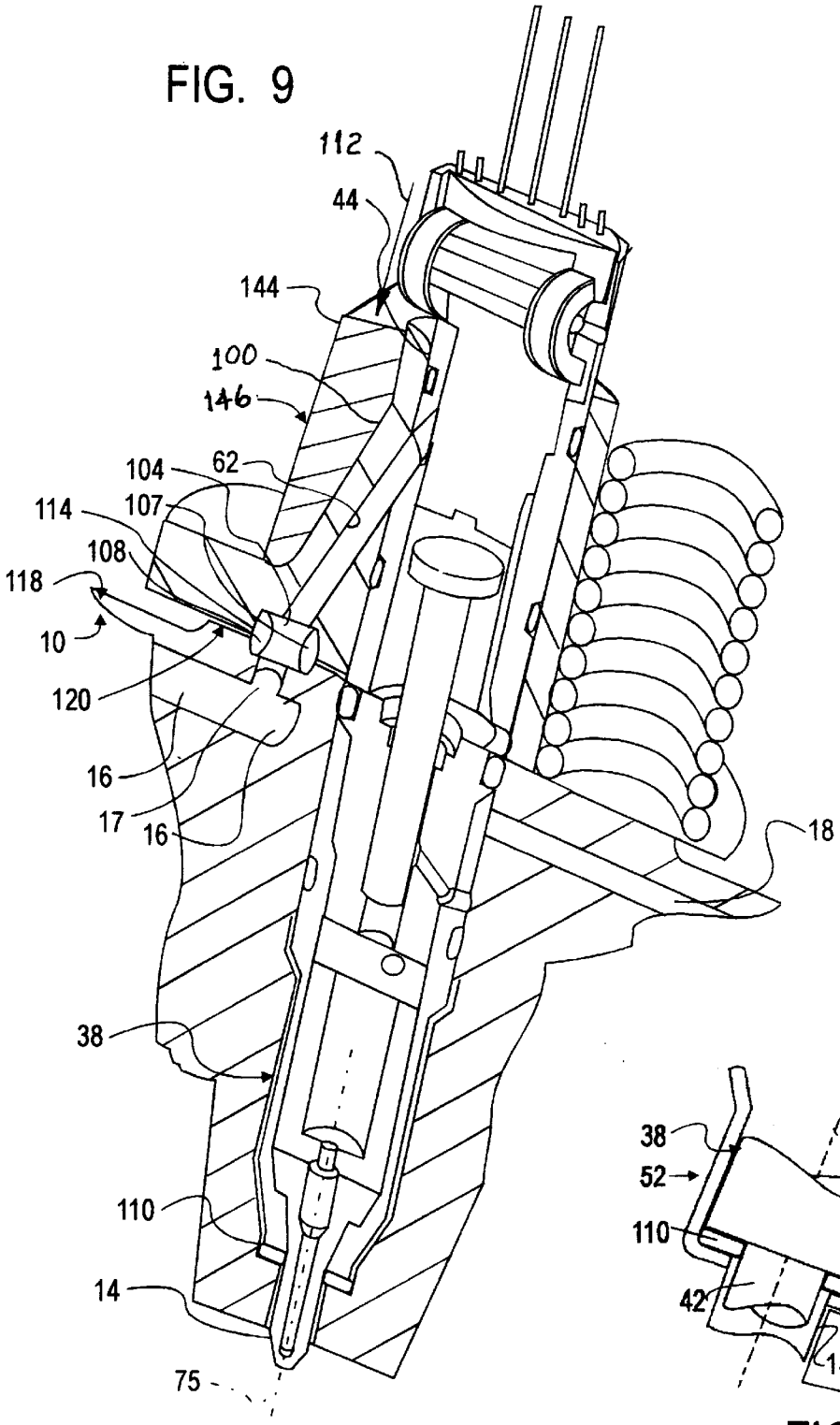
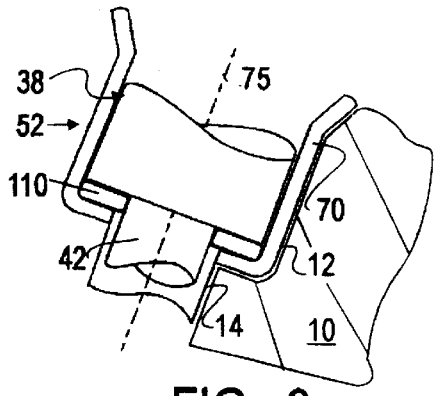
FIG. 9a

FUEL INJECTOR

TECHNICAL FIELD

The present invention relates to a fuel injector for an internal combustion engine. More particularly, the present invention relates to apparatus for clamping and fluidly sealing the fuel injector to an object.

BACKGROUND OF THE INVENTION

A fuel injector must perform its prime function of delivering a desired fuel charge to an engine cylinder within a number of constraints. The first such constraint is a physical space constraint. The fuel injector must reside coincident with a plurality of valves and valve springs. With the need for increased efficiencies of internal combustion engines, the number of valves that service a cylinder has grown from the traditional two valves common only a few years ago to three, four, and even five valves. The fuel injection unit is forced to reside within the cluster of valves servicing the cylinder.

Another constraint within which the fuel injector must live is the need to provide adequate fluid sealing for a number of different passageways that must be coupled to the fuel injector. Due to manufacturing tolerances and the great fluid pressures involved, it has in the past proved difficult to consistently and effectively simultaneously seal the various fluid passageways that are coupled to the fuel injector. Additionally, present means for clamping the fuel injector to the engine cylinder head have imposed torque moments to the passageway seals, the torque moments contributing to seal leakage over time.

A fluid passageway that must be sealed is the passageway surrounding the injector tip where the tip projects into the combustion chamber. The pressure generated by ignition of the injected fuel is typically on the order of 2,500 pounds per square inch acting to leak around the fuel injector tip.

A number of current fuel injector designs employ a high pressure engine lubricating oil to actuate an intensifier plunger within the fuel injector to bring the pressure of the fuel at the time of injection up to approximately 20,000 pounds per square inch. The high pressure lubricating oil is delivered through a rail defined in the cylinder head to the fuel injector. The high pressure lubricating oil is typically at a pressure of approximately 3,500 pounds per square inch. The high pressure lubricating oil must be fluidly coupled from the rail to the fuel injector. This is a second fluid passageway that must be sealed.

There is a need in the industry to consistently clamp the fuel injector into place on the cylinder head. The clamping action must effect fluid seals at least at the injector tip and at the interface with the high pressure lubricating oil rail. Additionally, the means for clamping must be compatible with the limited space available in the cluster of valves servicing at the cylinder. Further, it would be a benefit to the industry for the clamping to minimize the effects of manufacturing tolerances on effecting the fluid seals and minimizing the torquing forces that the clamping action subjects the various fluid seals to.

SUMMARY OF THE INVENTION

The present invention substantially meets the aforementioned needs of the industry. The unit injector of the present invention includes devices for clamping the unit injector to the cylinder head that are compatible with the space limitations afforded by a number of different valve and valve spring arrangements. Additionally, the unit injector provides for fluid sealing of a plurality of orifices that minimize the effects of manufacturing tolerances in both the fuel injector and the cylinder head in which the fuel injector is installed. Further, torquing forces that could effect seals at the plurality of orifices are minimized. Further, a passageway is provided to convey high pressure lubricating oil from the rail defined in the cylinder head to the unit injector.

The present invention is a clamping device for clamping a fuel injector to the cylinder head of an internal combustion engine, the fuel injector having a fuel injector body including a injector nozzle tip. The clamping device includes a hold down device for clamping to an object and a sealing device for effecting a fluid seal with a plurality of fluid passageways defined in the cylinder head, the sealing device associated with each fluid passageway being compressible by a unidirectional force applied to the hold down device. Further the present invention is a fuel injector for an internal combustion engine, the fuel injector having a fuel injector body including an injector nozzle tip. The fuel injector includes a hold down device for clamping to an object and a sealing device for effecting a fluid seal with a plurality of fluid passageways defined in the object, at least one sealing device having a dimensional range in which an effective seal is made, the dimensional range being at least as great as the range of manufacturing tolerances existing between the fuel injector and the object.

BRIEF DESCRIPTION OF THE DRAWINGS

FIG. 2 is a sectional side view of a crush barrel seal for sealing the connection with the high pressure lubricating oil rail;

FIG. 3 is an alternative preferred embodiment of the crush barrel seal for use at the junction with the high pressure lubricating oil rail;

FIG. 4 is a side sectional view of a crush barrel seal and employed to form a seal at the injector tip of the unit injector;

FIG. 5 is a top plan form view of a unit injector disposed between two valve springs, the high pressure lubricating oil passageway and seal being depicted in section;

FIG. 6*a* is a sectional view of an alternative means for sealing the jumper tube of FIG. 6;

FIG. 6*b* is a sectional view of an alternative means for sealing the jumper tube of FIG. 6;

FIG. 9 is a perspective sectional view of a further preferred embodiment of the unit injector of the present invention; and FIG. 9*a* is a side elevational view of the injector tip of the unit injector having the sleeve and washer seal depicted in section.

DETAILED DESCRIPTION OF THE PREFERRED EMBODIMENT

Figure 1:
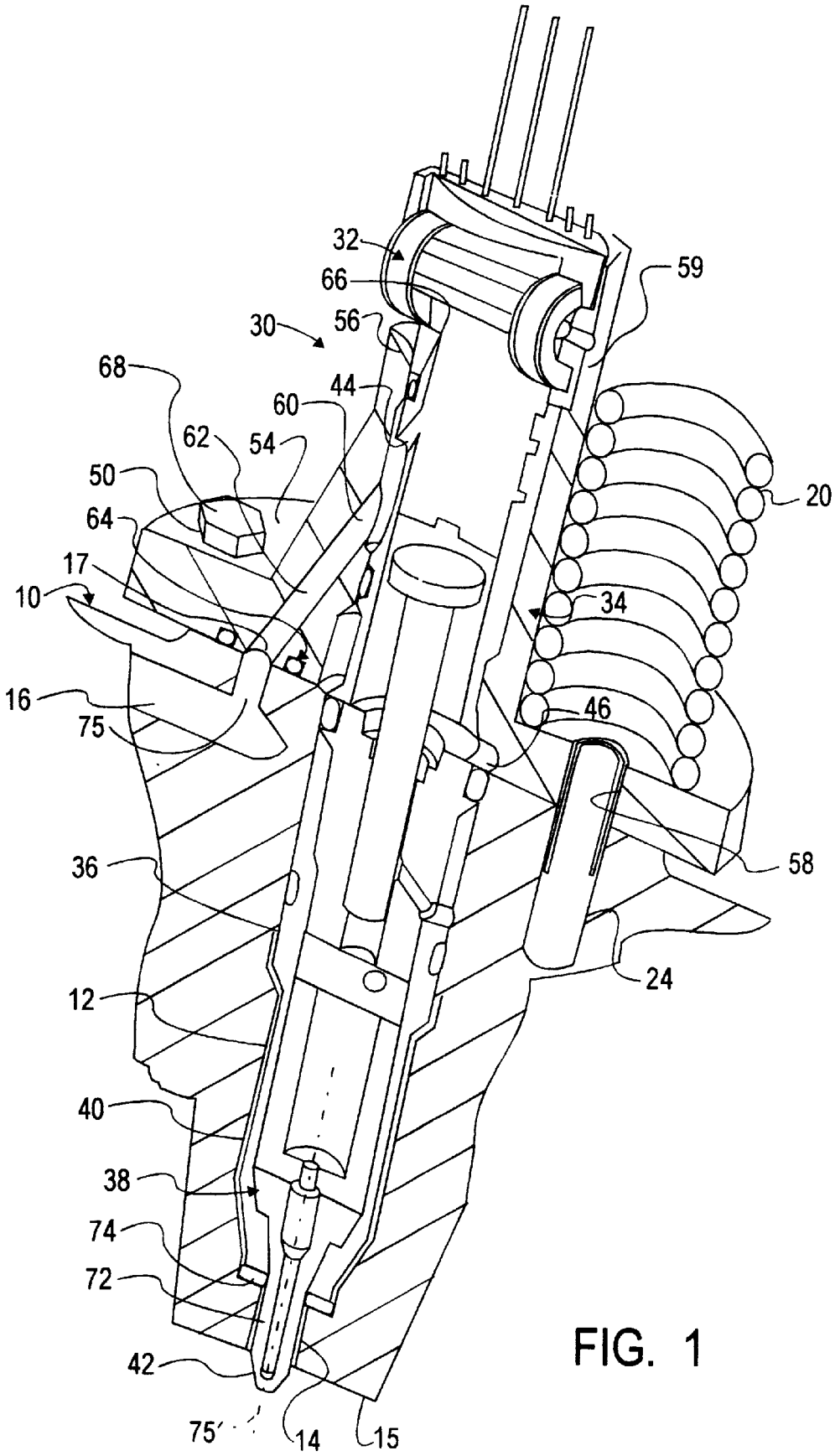
FIG. 1 is a sectional perspective view of the unit injector of the present invention.

FIG. 1 depicts a plurality of engine components in relation to the unit injector of the present invention. The engine components include a cylinder head 10. An injector receiver 12 is defined in the cylinder head 10. The injector receiver 12 has a generally circular cross section that decreases in diameter in several stages as the depth of the injector receiver 12 increases into the cylinder head 10. At the bottom of the injector receiver 12 an injector valve bore 14 extends between the injector receiver 12 and the combustion chamber (not shown). A portion of the combustion chamber wall 15 that defines the combustion chamber is depicted adjacent to the injector valve bore 14.

A high pressure oil rail 16 is defined in the cylinder head 10. The high pressure oil rail 16 terminates in an opening 17 at the surface of the cylinder head 10. In the embodiment depicted in FIG. 9, a fuel rail 18 is additionally defined in the cylinder head 10 for providing a fuel supply to the unit injector. Returning to FIG. 1, a single valve spring 20 is depicted. Additional valve springs 20*a* and 20*b* as depicted in FIG. 5. A valve guide 24 is disposed within the cylinder head 10. A valve guide 24 is paired with each of the valves in order to facilitate the translational motion of the valves between an opened and a closed disposition.

The unit injector of the present invention is shown generally at 30 in FIG. 1. The unit injector 30 may be any of a number of different types of fuel injector units, but is preferably a component of a hydraulically-actuated electronically-controlled unit injector fuel system as presented in U.S. Pat. No. 5,191,867, incorporated herein by reference.

The unit injector 30 includes an actuator and valve assembly 32, a body assembly 34, a barrel assembly 36, and a nozzle and tip assembly 38. The nozzle and tip assembly 38 is disposed within a case 40. The nozzle tip 42 projects through the injector valve bore 14 into the combustion chamber (not shown). A high pressure oil inlet 44 is defined in the body assembly 34 of the unit injector 30. An oil drain 46 is defined in the body assembly 34 of the unit injector 30.

The injector 30 further includes an injector retainer assembly 50 and a sleeve assembly 52. The injector retainer assembly 50 of the unit injector 30 has a generally circular hold down dog 54 disposed peripheral to the body assembly 34 of the unit injector 30. The dog 54 subtends a certain angle to underlie at least one valve spring. The hold down dog 54 has a bore 58 defined therein. The bore 58 is in registry with the valve guide 24 pressed into the cylinder head 10.

A retainer wall 56 extends upward from the hold down dog 54. The retainer wall embraces the outer surface of the body assembly 34 of the unit injector 30. The retainer wall 56 has a relatively thin cross sectional area where the retainer wall 56 is adjacent to a valve spring 20. The relatively thin cross sectional portions of the retainer wall 56 accommodate the minimal space defined between adjacent valve springs 20*a*–20*d* for the unit injector 30 to reside in. The retainer wall 56 may be formed integral with the body assembly 34 of the unit injector 30 or the retainer wall 56 may be formed separate and comprise a sleeve substantially encompassing the body assembly 34.

A generally angled passageway support 60 extends between the hold down dog 54 and the retainer wall 56. An oil passageway 62 is defined in the passageway support 60. The oil passageway 62 is fluidly coupled at a first end to the high pressure oil rail 16 at the opening 17 thereof. The juncture of the oil passageway 62 and the high pressure oil rail 16 is sealed by an O-ring 64. The oil passageway 62 is fluidly coupled to the high pressure oil inlet 44 at an opposed second end. The juncture of the oil passageway 62 and the high pressure oil inlet 44 is sealed by an O-ring 66. The circular hold down dog 54 is maintained in compressive engagement with the surface of the cylinder head 10 by a bolt 68 threaded into a threaded bore defined in the cylinder head 10 and by portions of the hold down dog 54 underlying and being held in compressive engagement with the cylinder head 10 by the valve springs 20*a*–20*d*.

The sleeve assembly 52 of the unit injector 30 is interposed between the case 40 of the nozzle and tip assembly 38 and the interior surface of the injector receiver 12. A bore 72 is defined in the lower extremity of the sleeve 70. The bore 72 is in registry with the injector valve bore 14 in order to accommodate the passage of the valve tip 42 into the combustion chamber. A sealing washer 74 is interposed between the case 40 of the nozzle and tip assembly 38 and the sleeve 70. The sealing washer 74 and the O-ring 64 each have a compression axis 75. The compression axes 75 are substantially parallel to the direction of the clamping force exerted by the bolt 68 and the valve springs 20. Accordingly, no torque moment is applied to the O-ring 64 or the sealing washer 74.

Figures 7, 8:
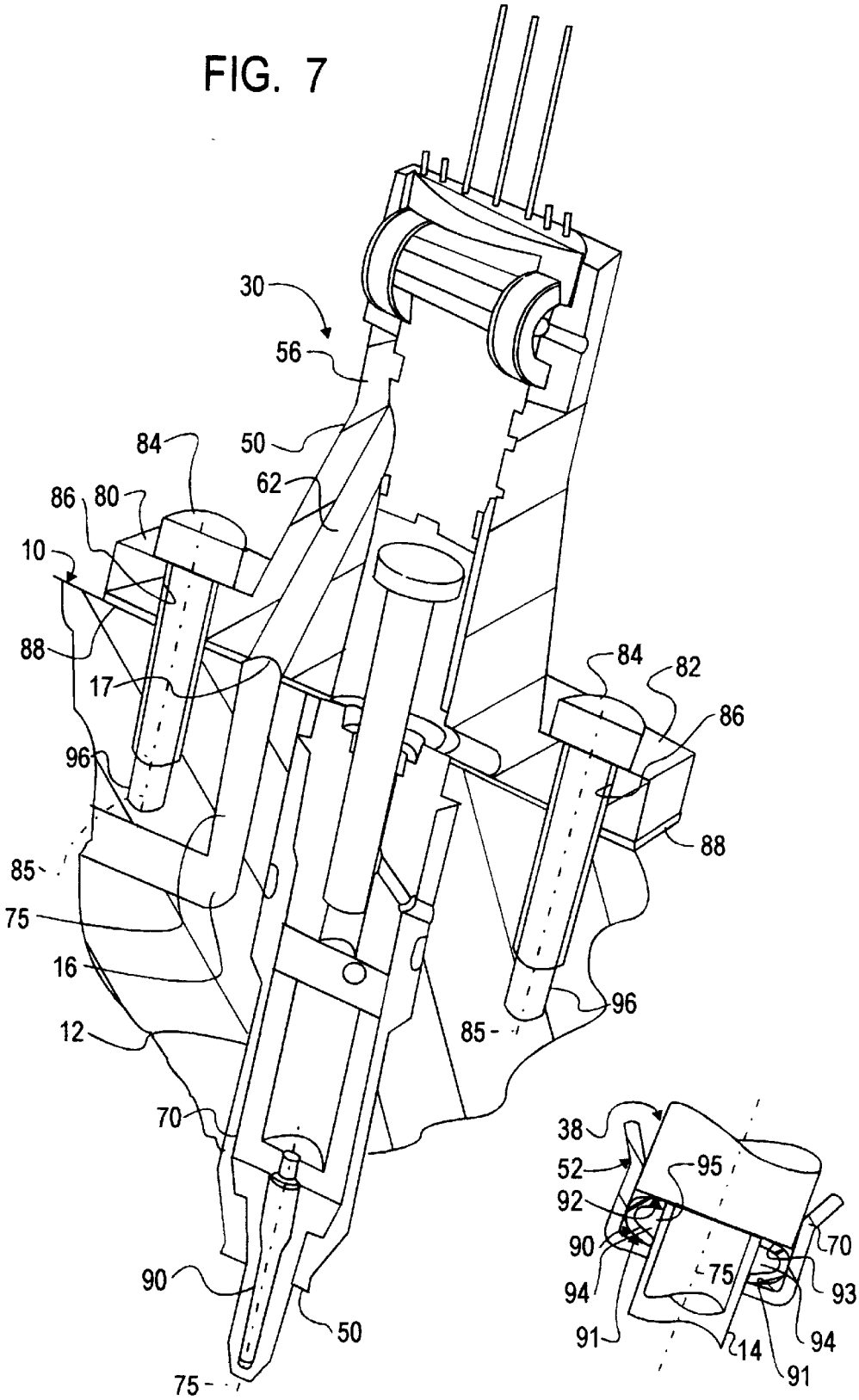
FIG. 7 is a perspective sectional view of an alternative embodiment of the unit injector of the present invention.
FIG. 8 is a side elevational view of the injector tip of the unit injector having the sleeve and crush barrel seal depicted in section.

Turning to FIG. 7, in which like numerals denote like components, a second preferred embodiment of the unit injector 30 of the present invention is depicted. The injector retainer assembly 50 in this embodiment is designed to fit between the valves 22 and valve springs 20 that service the same cylinder as the unit injector 30. Accordingly, no portion of the injector retainer assembly 50 underlies the valve springs 20 as in the embodiment of FIG. 1. The retainer wall 56 of the injector retainer assembly 50 is supported by two diametrically opposed hold down arms 80, 82. The hold down arms 80, 82 have a relatively narrow width dimension in order to accommodate disposition between the plurality of valve springs 20. Each hold down arm 80, 82 is fixedly coupled to the cylinder head 10 by a bolt 84 that is disposed in a bore 86 defined in the hold down ear 80, 82 and threaded into a threaded bore defined in the cylinder head 10. Each bolt 84 has a longitudinal axis 85. The clamping force exerted by the bolts 84 is exerted along the axis 85.

A gasket 88 is positioned between the underside surface of the hold down arms 80, 82 and the surface of the cylinder head 10. It is significant to note that the gasket 82 provides for the fluid seal at the opening 17 of the high pressure oil rail 16 with the oil passageway 62 of the injector retainer assembly 50. The gasket 88 has a compression axis 75 depicted transverse to the opening 17 and parallel to axis 85 of bolts 84. In order to effect this seal the gasket 88 must in all cases be compressed to a desired compression by a force acting parallel to axis 75. In order to accommodate for the manufacturing tolerances that exist between various unit injectors 30 and various injector receivers 12 defined in the cylinder head 10, a crushable barrel seal 90 is utilized. As depicted in FIG. 8, the crushable barrel seal 90 is positioned circumferential to the tip 42 of the unit injector 30 between inner bottom surface 91 of the injector sleeve 70 of the sleeve assembly 52 and an opposing surface 93 of the nozzle and tip assembly 38. The barrel seal 90 has a compression axis 75 that is substantially parallel to axis 85 of bolts 84 and to axis 75 of gasket 88. The crushable barrel seal 90 has a crushable member 92 that is preferably formed in the manner of a sleeve having a bore 95 defined along the compression axis 75. The crushable member 92 is preferably formed of a metallic material. The crushable barrel seal 90 has a sealing member 94 bonded to the interior surface of the bore 95 defined within the crushable member 92. The sealing member is preferably formed of a rubber-like material. The crushable member 92 is substantially non-resilient, making the barrel seal 90 a single use device.

In operation, the sleeve 70 of the sleeve assembly 52 is positioned in the injector receiver 12. The unit injector 30 is then positioned within the sleeve 70 with the uncrushed crushable barrel seal 90 positioned between surfaces 91 and 93. The bores 86 defined in the hold down arms 80, 82 are brought into registry with the threaded bore 96 defined in the cylinder head 10. The bolts 84 are then threaded into the threaded bores 96 exerting a force aligned with axis 85 of bolts 84. As the bolts 84 are snugged down to achieve the desired compression of the gasket 88, the crushable barrel seal 90 is slowly crushed along compression axis 75 to achieve the bowed configuration depicted in FIG. 8. As the crushable member 92 is bowed, the sealing member 94 is pressed firmly against the exterior surface of the tip 42, thereby assisting in forming the fluid seal. Once the gasket 88 is compressed a desired amount along compression axis 75, the bolts 84 are no longer snugged and the degree of crush of the crushable barrel seal 90 is set. Since the compressive force exerted by the bolts 84 along axis 85 is parallel to the compression axis 75 of both the gasket 88 and the barrel seal 90, no torque moment is applied to either the gasket 88 or the seal 90.

The crushable barrel seal 90 has a height dimension along the compression axis 75 that is sufficient to accommodate a range of the amounts of crush sustainable in order to accommodate the varying manufacturing tolerances that exist in the unit injector 30 and the cylinder head 10. Throughout this range of crush, an effective fluid seal is formed around the tip 42. In this manner, the crushable barrel seal 90 accommodates the range of manufacturing tolerances thus permitting the gasket 88 to be compressed as needed in all cases to effect a fluid seal between the high pressure oil rail 16 and the oil passageway 62 defined in the injector retainer assembly 50 while at the same time effecting a fluid seal at tip 42 with barrel seal 90.

A third preferred embodiment of the unit injector 30 of the present invention is depicted in FIG. 9. Like numerals in FIG. 9 denote like components. The housing of the unit injector 30 depicted in FIG. 9 includes a single hold down arm 100. The hold down arm 100 has an oil passageway 62 defined therein to fluidly couple the high pressure oil inlet 44 and the high pressure oil rail 16.

A conventional hold down crab partially shown in section at 144 secured to the cylinder head by a bolt (not shown) has an arm portion 146 which applies an axially downward load through the hold down arm 100 to the unit injector 30 to secure it against the pressure of ignition firing, the pressure needed for effective seal crushing, and the hydraulic pressure exerted by high pressure lubricating oil acting upwardly on the hold down arm 100. The arrow 112 shows the downward force exerted by the hold down crab 144 to be axially aligned with the compression axis 75 of the barrel crushable seal 104.

The barrel crushable seal 104 is interposed between the high pressure oil rail 16 and the oil passage 62 at the opening 17 to the high pressure oil rail 16. The barrel crushable seal has a generally sleeve like crushable member 106 having a bore 107 axially defined therethrough coaxial with a compression axis 75. A sealing member 108 is bonded to the interior surface of the crushable member 106. The barrel crushable seal 104 is disposed in an annular recess 114 defined in the hold down arm 100 and a corresponding annular recess 116 defined in the cylinder head 10.

The barrel crushable seal 104 is depicted in FIG. 2, after a crushing force has been applied thereto parallel to the compression axis 75. The barrel crushable seal 104 is given a bias at manufacture such that application of a crushing force causes the crushable member 106 to bow outward as depicted in FIG. 2. Referring to FIG. 3, the barrel crushable seal 104 is given a bias at manufacture in which the crushable member 106 bows inward upon application of a crushing force parallel to the compression axis 75.

Referring again to FIG. 9, a washer seal 110 is disposed between an underside surface of the nozzle and tip assembly 38 and the inside surface of the sleeve 70. Upon application of a desired compressive force to the washer seal 110, parallel to the compression axis 75, an effective fluid seal is formed at the circumference of the tip 42. The washer seal 110 is best viewed with reference to FIG. 9*a*.

Assembly and machining tolerances of both the cylinder head 10 and the unit injector 30 are accommodated by the unit injector 30 of FIGS. 9 and 9*a* by means of the barrel crushable seal 104. As the hold down crab 144 applies downward pressure on the injector retainer assembly 50 parallel to the compression axis 75, crushing of the barrel crushable seal 104 commences when there is still a gap between the underside surface of the injector retainer assembly 50 of the unit injector 30 and the surface of the cylinder head 10 as indicated by arrows 118. The hold down crab 144 continues to apply downward force on the unit injector 30 until a desired compression of the washer seal 110 is effected. At this point, a tolerance gap indicated by arrows 120 remains between the underside surface of the injector retainer assembly 50 and the surface of the cylinder head 10. At this point, sufficient crush has been effected in the barrel crushable seal 104, as depicted in FIGS. 2 and 3, to effect a fluid seal between the high pressure oil rail 16 and the oil passageway 62 defined in the injector retainer assembly 50.

FIGS. 5 and 5*a* depict a further preferred embodiment of the present invention. The unit injector 30 is positioned proximate to valve springs 20*a*, 20*b* with a single hold down arm 130 extending from the actuator and valve assembly 32 of the unit injector into the gap defined between the valve springs 20*a* and 20*b*. The hold down arm 130 is a portion of the injector retainer assembly 50. The hold down arm 130 is fixedly coupled to a retainer wall 56, formed to circumferentially encompass the actuator and valve assembly 32 of the unit injector 30.

The hold down arm 130 has a oil passageway 62 defined therein. The oil passageway 62 terminates at the juncture with the cylinder head 10 in a recess 114 that is adapted to receive a crushable type seal as previously described. A single bolt 132 is passed through a bore defined in the hold down arm 130. The bolt 132 is long enough to threadedly engage a threaded bore defined in the cylinder head 10. Tightening of the bolt 132 applies a force to the unit injector 30 that is parallel to the compression axis of crushable-type seal disposed in the recess 114.

Figure 6:
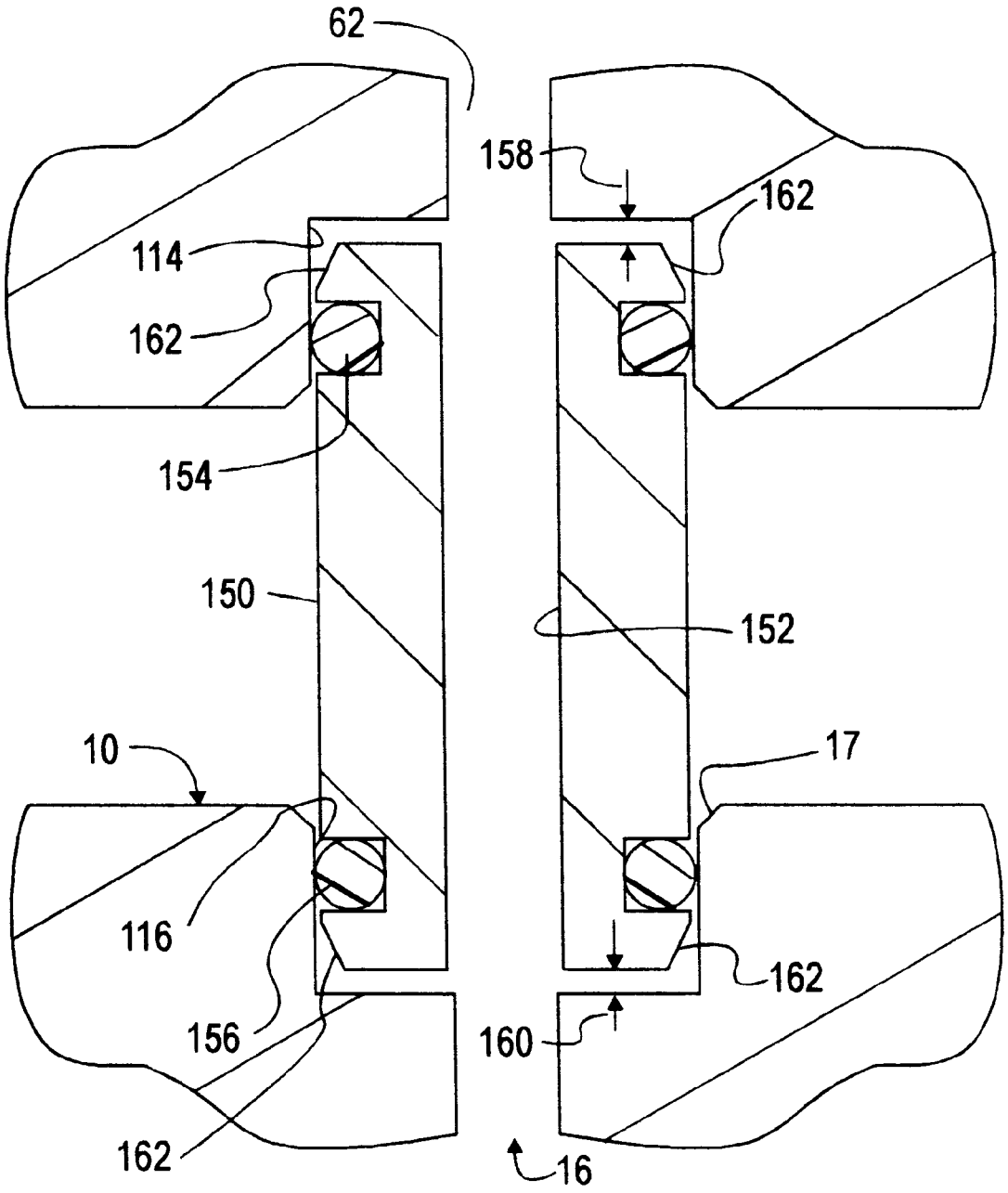
FIG. 6 is a side sectional view of a jumper tube seal employed at the juncture with the high pressure lubricating oil rail.

FIGS. 4 and 6 depict two additional preferred embodiments of crushable seals. FIG. 4 depicts a ring seal 140. The ring seal 140 has a C-shaped cross section. A bore 142 is defined coaxial with the longitudinal compression axis 144 of the ring seal 140.

The ring seal 140 is depicted in FIG. 4 positioned circumferentially encompassing the tip 42 of the nozzle and tip assembly 38. The upper margin of the ring seal 140 is in contact with the surface 93. The lower margin of the ring seal 140 is in contact with the surface 91 comprising the inner lower portion of the sleeve 70.

Turning to FIG. 6, a jumper tube 150 is disposed between the unit injector 30 and the cylinder head 10 in order to seal the juncture between the high pressure oil rail 116 and the oil passageway 62. The jumper tube 150 has an axial bore 152 defined therein having generally the same diameter as the oil passageway 62 and the high pressure oil rail 16. The axis of the bore 152 defines the compression axis of the jumper tube 150. Sealing of the jumper tube 150 is provided by O-rings 154 and 156. The O-ring 154 sealingly mates with the surface of the recess 114. The O-ring 156 sealingly mates with the surface of the recess 116.

The jumper tube 150 is designed to accommodate the manufacturing tolerances as previously described, not by crushing but by the spaces defined between the respective ends of the jumper tube 150 and the horizontal surface of the recesses 114, 116, as indicated by the arrows 158, 160. Compression parallel to the compression axis of the jumper tube 150 does not apply a torquing moment to jumper tube 150.

Referring to FIG. 6*a*, an alternative method of sealing the jumper tube 150 is depicted. In this case, the beveled edge 162 of the jumper tube 150 compresses a O-ring 164 in the corner of the recess 114, 116. FIG. 6*b* depicts a further means of sealing the jumper tube 150. In the embodiment of FIG. 6*b*, an O-ring groove 166 is defined proximate the horizontal surface of the recess 114, 116. In this case, the jumper tube has a squared corner as distinct from the bellow 162 of FIGS. 6 and 6*a*. The squared comer 170 of the jumper tube 150 compresses the O-ring 168 in the O-ring groove 166 to affect the fluid seal.

Although a certain specific embodiment of the present invention has been shown and described, it is obvious that many modifications and variations thereof are possible in light of the teachings. It is to be understood therefore that within the scope of the appended claims, the invention may be practiced otherwise than as specifically described herein.

What is claimed is:

1. A fuel injector for an internal combustion engine, the fuel injector having a fuel injector body including a injector nozzle tip, comprising;

hold down means for clamping to an object; and seal means for effecting a fluid seal with a plurality of fluid passageways defined in the object, the seal means including a crushable seal having a bore defined along a longitudinal axis and being deformable longitudinally to effect a fluid seal between the fuel injector and an object, at least one seal means having a dimensional range in which an effective seal is made, the dimensional range being at least as great as the range of manufacturing tolerances existing between the fuel injector and the object.

2. The fuel injector of claim 1 wherein the hold down means includes a first arm having a fluid passageway defined therein, the fluid passageway being fluidly couplable to a fluid rail defined in the object.

3. The fuel injector of claim 1 wherein the hold down means includes a second arm, the second arm being positioned diametrically opposed to the first arm.

4. The fuel injector of claim 1 wherein the hold down means includes a hold down dog, the hold down dog being positioned substantially transverse to a fuel injector longitudinal axis.

5. The fuel injector of claim 4 wherein the hold down dog is compressively clampable to the object by engagement with at least one valve spring.

6. The fuel injector of claim 5 wherein the hold down dog extends radially from the fuel injector body and subtends a certain arc to be engageable by a plurality of valve springs.

7. The fuel injector of claim 1 wherein the object has a fuel injector receiver defined therein, the fuel injector further including sleeve means, the sleeve means being receivable within the fuel injector receiver, the fuel injector body being receivable within the sleeve.

8. The fuel injector of claim 7 wherein the seal means includes tip seal means positioned in the sleeve means for effecting a fluid seal proximate the injector nozzle tip.

9. The fuel injector of claim 1 wherein the crushable seal includes a crushable member and a sealing member, the sealing member being operably coupled to an interior surface of the crushable member.

10. The fuel injector of claim 9 wherein the crushable seal crushable member has a selectable bias such that, upon deformation, the crushable member assumes a concave or a convex shape as desired.

11. The fuel injector of claim 1 wherein the seal means includes a jumper tube having a bore defined along a longitudinal axis and a first end and a second opposed end, the jumper tube being compressively engageable with an O-ring positioned proximate the first end to effect a fluid seal with the fuel injector and being compressively engageable with an O-ring positioned proximate the second end to effect a fluid seal with an object.

12. The fuel injector of claim 11 wherein the jumper tube an O-ring is disposed in a first O-ring groove defined in an exterior surface of the jumper tube proximate the first end thereof and an O-ring is disposed in a second O-ring groove defined in an exterior surface of the jumper tube proximate the second end thereof.

13. A clamping device for clamping a fuel injector to the cylinder head of an internal combustion engine, the fuel injector having a fuel injector body including a injector nozzle tip, comprising;

hold down means for clamping to an object; and seal means for effecting a fluid seal with a plurality of fluid passageways defined in the object, at least one seal means having a dimensional range in which an effective seal is made, the dimensional range being at least as great as the range of manufacturing tolerances existing between the fuel injector and the object, the seal means includes a crushable seal having a bore defined along a longitudinal axis and being deformable longitudinally to effect a fluid seal between the clamping device and the cylinder head.

14. The clamping device of claim 13 wherein the hold down means includes a first arm having a fluid passageway defined therein, the fluid passageway being fluidly couplable to a fluid rail defined in the cylinder head.

15. The clamping device of claim 13 wherein the hold down means includes a second arm, the second arm being positioned diametrically opposed to the first arm.

16. The clamping device of claim 13 wherein the hold down means includes a hold down dog, the hold down dog being positioned substantially transverse to a clamping device longitudinal axis.

17. The clamping device of claim 16 wherein the hold down dog is compressively clampable to the cylinder head by engagement with at least one valve spring.

18. The clamping device of claim 17 wherein the hold down dog extends radially from the clamping device body and subtends a certain arc to be engageable by a plurality of valve springs.

19. The clamping device of claim 13 wherein the cylinder head has an injector receiver defined therein, the injector further including sleeve means, the sleeve means being receivable within the injector receiver, the injector body being receivable within the sleeve.

20. The clamping device of claim 19 wherein the seal means includes tip seal means positioned in the sleeve means for effecting a fluid seal proximate the injector nozzle tip.

21. The clamping device of claim 13 wherein the crushable seal includes a crushable member and a sealing member, the sealing member being operably coupled to an interior surface of the crushable member.

22. The clamping device of claim 21 wherein the crushable seal crushable member has a selectable bias such that, upon deformation, the crushable member assumes a concave or a convex shape as desired.

23. The clamping device of claim 13 wherein the seal means includes a jumper tube having a bore defined along a longitudinal axis and a first end and a second opposed end, the jumper tube being compressively engageable with an O-ring positioned proximate the first end to effect a fluid seal with the clamping device and being compressively engageable with an O-ring positioned proximate the second end to effect a fluid seal with the cylinder head.

24. The clamping device of claim 23 wherein the jumper tube an O-ring is disposed in a first O-ring groove defined in an exterior surface of the jumper tube proximate the first end thereof and an O-ring is disposed in a second O-ring groove defined in an exterior surface of the jumper tube proximate the second end thereof.

25. A clamping device for clamping a fuel injector to the cylinder head of an internal combustion engine, the fuel injector having a fuel injector body including a injector nozzle tip, comprising;

hold down means for clamping to an object; and seal means for effecting a fluid seal with a plurality of fluid passageways defined in the cylinder head, the sealing means associated with each fluid passageway being compressible by a uni-directional force applied to the hold down means, each sealing means having an axis of compression, the unidirectional force applied to the hold down means being applied in a direction substantially parallel to the axis of compression of each of the sealing means.

26. The clamping device of claim 25 wherein at least one seal means having a dimensional range along the compression axis in which an effective seal is made, the dimensional range being at least as great as the range of manufacturing tolerances existing between the fuel injector and the object.

27. The clamping device of claim 25 wherein the hold down means includes a first arm having a fluid passageway defined therein, the fluid passageway being fluidly couplable to a fluid rail defined in the cylinder head.

28. The clamping device of claim 25 wherein the hold down means includes a second arm, the second arm being positioned diametrically opposed to the first arm.

29. The clamping device of claim 25 wherein the hold down means includes a hold down dog, the hold down dog being positioned substantially transverse to a clamping device longitudinal axis.

30. The clamping device of claim 29 wherein the hold down dog is compressively clampable to the cylinder head by engagement with at least one valve spring.

31. The clamping device of claim 30 wherein the hold down dog extends radially from the clamping device body and subtends a certain arc to be engageable by a plurality of valve springs.

32. The clamping device of claim 25 wherein the cylinder head has an injector receiver defined therein, the injector further including sleeve means, the sleeve means being receivable within the injector receiver, the injector body being receivable within the sleeve.

33. The clamping device of claim 32 wherein the seal means includes tip seal means positioned in the sleeve means for effecting a fluid seal proximate the injector nozzle tip.

34. The clamping device of claim 33 wherein the seal means includes a crushable seal having a bore defined along a longitudinal axis and being deformable longitudinally to effect a fluid seal between the clamping device and an cylinder head.

35. The clamping device of claim 34 wherein the crushable seal includes a crushable member and a sealing member, the sealing member being operably coupled to an interior surface of the crushable member.

36. The clamping device of claim 35 wherein the crushable seal crushable member has a selectable bias such that, upon deformation, the crushable member assumes a concave or a convex shape as desired.

37. The clamping device of claim 25 wherein the seal means includes a jumper tube having a bore defined along a longitudinal axis and a first end and a second opposed end, the jumper tube being compressively engageable with an O-ring positioned proximate the first end to effect a fluid seal with the clamping device and being compressively engageable with an O-ring positioned proximate the second end to effect a fluid seal with the cylinder head.

38. The clamping device of claim 37 wherein an O-ring is disposed in a first O-ring groove defined in an exterior surface of the jumper tube proximate the first end thereof and an O-ring is disposed in a second O-ring groove defined in an exterior surface of the jumper tube proximate the second end thereof.

* * * * *